United States Patent [19]

Zell

[11] Patent Number: 4,577,612

[45] Date of Patent: Mar. 25, 1986

[54] ARROW HOLDER

[75] Inventor: John T. Zell, 2676 Clute Rd., Boyne City, Mich. 49712

[73] Assignees: John T. Zell, Boyne City; Michael R. Franchino, Petoskey, both of Mich.

[21] Appl. No.: 621,368

[22] Filed: Jun. 18, 1984

[51] Int. Cl.[4] ..... F41D 10/00; F41B 5/00

[52] U.S. Cl. ..... 124/41 A; 124/24 R

[58] Field of Search ..... 124/23 R, 24 R, 41 A, 124/35 A

[56] References Cited

U.S. PATENT DOCUMENTS 2,483,928 10/1949 Ott ..... 124/41 A

*Primary Examiner*—Richard C. Pinkham
*Assistant Examiner*—Benjamin Layno
*Attorney, Agent, or Firm*—John F. Rohe

[57] ABSTRACT

A trigger actuated arrow holder which attaches to the side of an archery bow is disclosed herein. An arrow clamp is spring biased against the body of the bow, such that it securely holds an arrow in place. When the trigger is depressed, the arrow clamp rotates away from the body of the bow thereby facilitating the passage of an arrow when a drawn bowstring is released.

5 Claims, 13 Drawing Figures

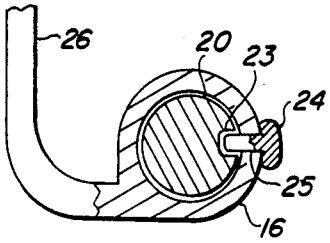
FIG. 4
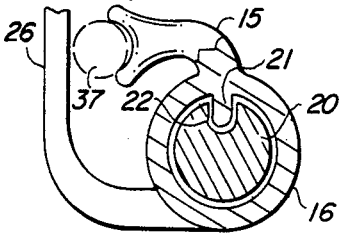
FIG. 5A
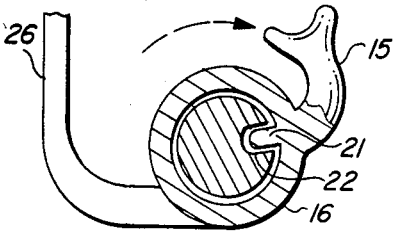
FIG. 5B
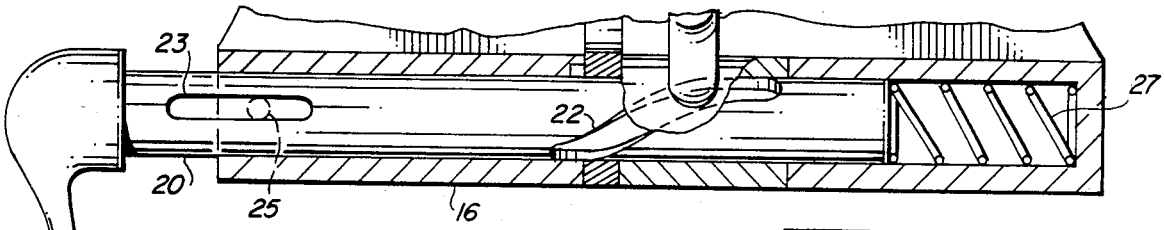
FIG. 6A
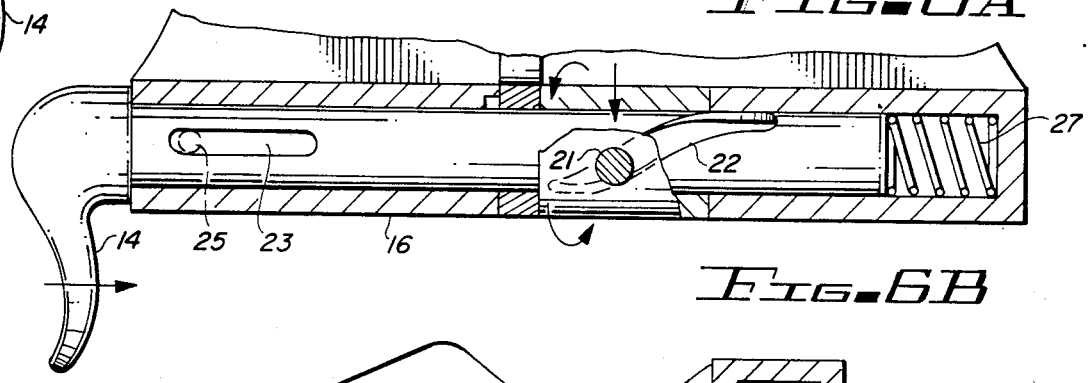
FIG. 6B
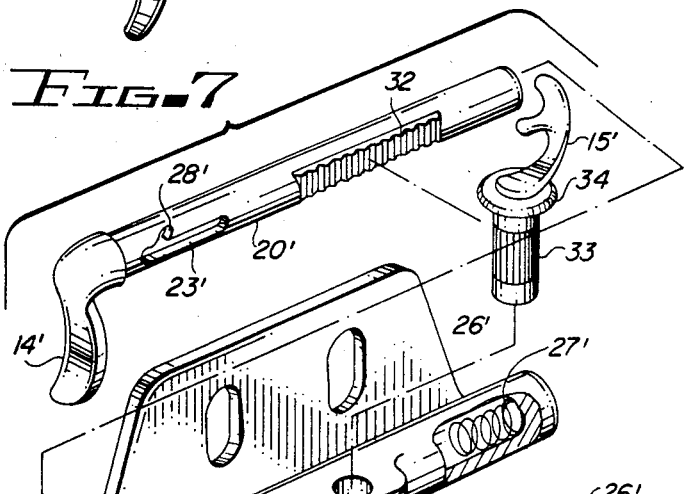
FIG. 7
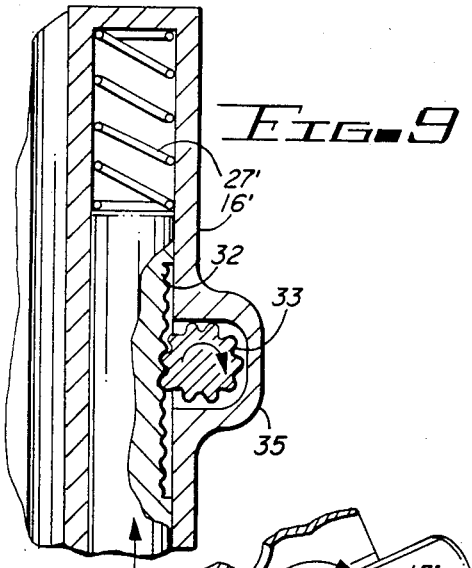
FIG. 9
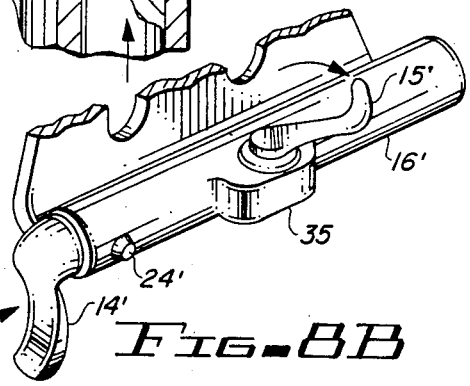
FIG. 8A
FIG. 8B

ARROW HOLDER

TECHNICAL FIELD

This invention relates generally to accessories for an archery bow, and more particularly to a means for securing an arrow against the archery bow.

BACKGROUND OF THE INVENTION

When bow hunting, it is advantageous to use arrows that are no longer than necessary to accommodate the full draw of a bow since the weight of the arrow has an effect upon its line of flight, trajectory and accuracy. Therefore, when an arrow if fully drawn, and where razorsharp broadheads are used as the arrowhead, there is a risk of injury to the bow hunter's forefinger, which is commonly used as a guide for the arrow. It may be noted that while the arrow is being drawn, the bowstring is caused to rotate since the knock (the locking mechanism at the rear of the arrow) is locked onto the bowstring. The bowstring rotates as it is drawn and the arrow is likewise caused to rotate. It is essential that the hunter's finger, or some other mechanism, hold the arrow in place to resist this normal rotational force while the bowstring is drawn. If the arrow is no longer than necessary to accommodate the full draw of the bow, the razorsharp arrowhead will invariably jeopardize the hunter's finger which is used to guide the arrow.

Also, it is advantageous for the hunter's forward arm, which holds the archery bow, to be fully extended. To the extent the hunter's wrist is caused to rotate upwards in order to allow his/her forefinger to hold the arrow in place, the ability to maintain a straight arm is compromised. The hunter's strength and stability is enhanced by maintaining a straight forward arm. An element of fatigue and instability is introduced by the rotation of a hunter's wrist.

The accuracy and ease of handling an archery bow is enhanced if the bow hunter's forefinger on the forward arm and wrist could remain in line with the remainder of the hunter's arm.

While hunting the bow hunter should be prepared for a prompt response if a target is located. Therefore, the bow hunter will typically retain an arrow in place, at rest, on the bow with his or her forefinger. Without an arrow retaining mechanism, it is necessary for the bow hunter's forefinger to hold the arrow against the bow. Over an extended period of time, this can cause fatigue. If the hunter's forefinger slips from the arrow there is also a risk of alarming the potential target.

In the prior art an arrow rest was typically attached to the body of a bow in order to support an arrow from below. This arrow rest had a shortcoming in that a released arrow would be deflected away from the body of the bow by the passing arrow vanes. Since it is necessary to support an arrow from below, it would be advantageous to minimize the potential deflection.

It would be advantageous to provide a mechanism which securely holds the arrow in place while the bowstring is at rest, and also while the string is drawn. The mechanism should also be removable from the arrow's line of flight so as not to interfere with the passage of the arrow and arrow vanes when the drawn bowstring is released. Furthermore, the device should facilitate the bow hunter's maintenance of a straight arm when the string is drawn. It is desirable to allow the hunter's forefinger to be removed from the path of a potentially dangerous razorsharp arrowhead when the arrow is drawn. The arrow holder should support an arrow from below in a manner whereby deflection of the arrow vanes is minimized. Finally, in the event a bow hunter is desirous of utilizing his forefinger as an arrow guide, it would be advantageous to provide a means for securely locking the arrow holding means away from the path of a drawn arrow.

SUMMARY OF THE INVENTION

An arrow holder has been developed in this invention which satisfies all of the foregoing needs. The arrow holder consists of a rotatable arrow clamp which is spring biased against an arrow placed adjacent to the body of an archery bow. The arrow clamp may thereby firmly retain the arrow against the body of the bow when the bowstring is at rest and also when it is drawn. In facilitating maximum stability and in minimizing fatigue when the bowstring is drawn, the invention permits the bow hunter's forward arm, wrist and forefinger to remain in line. In order to rotate the arrow clamp away from the path of a drawn arrow, the bow hunter simply depresses a trigger which is conveniently situated in the normal position of the hunter's forefinger. When the trigger is depressed, the arrow clamp is caused to rotate away from the path of the drawn arrow, thereby allowing its unobstructed passage when the drawn bowstring is released.

The invention disclosed herein sets forth two (2) specific means of rotating the arrow clamp when the trigger is depressed. The first consists of a spiral passageway, and the second of a rack and pinion gear. Both convert the linear movement of the trigger into a rotational movement of the arrow clamp. In both the spiral passageway and the rack and pinion gear mechanism, a spring biases the arrow clamp against the body of the bow when the trigger is not depressed.

In a preferred embodiment of the invention the arrow holder further comprises a mounting plate which facilitates its convenient attachment onto the body of an archery bow. The arrow holder may also include an arrow rest upon which an arrow is supported from below. The arrow rest may conveniently be attached to the arrow holder thereby providing a complete and independent unit which may be mounted on a bow.

BRIEF DESCRIPTION OF THE DRAWINGS

FIG. 4 is a cross-sectional view along line 4—4 of FIG. 2B;

FIG. 5A is a cross-sectional view along line 5—5 of FIG. 2A;

FIG. 5B is a cross-sectional view along line 5—5 of FIG. 2A, but with the trigger depressed;

FIG. 6A is a side view, in section, of the arrow holder in its "at rest" position;

FIG. 6B is a side view, in section, of the arrow holder with the trigger depressed;

FIG. 7 is a perspective side view of a disassembled arrow holder utilizing the rack and pinion method;

FIG. 8A is a perspective side view of an arrow holder utilizing the rack and pinion method, with the trigger in its "at rest" position;

FIG. 8B is a perspective side view of an arrow holder utilizing the rack and pinion method with the trigger depressed; and FIG. 9 is a cross-sectional top view of the arrow holder utilizing the rack and pinion method along line 9—9 of FIG. 8A.

DETAILED DESCRIPTION

Figure 1:
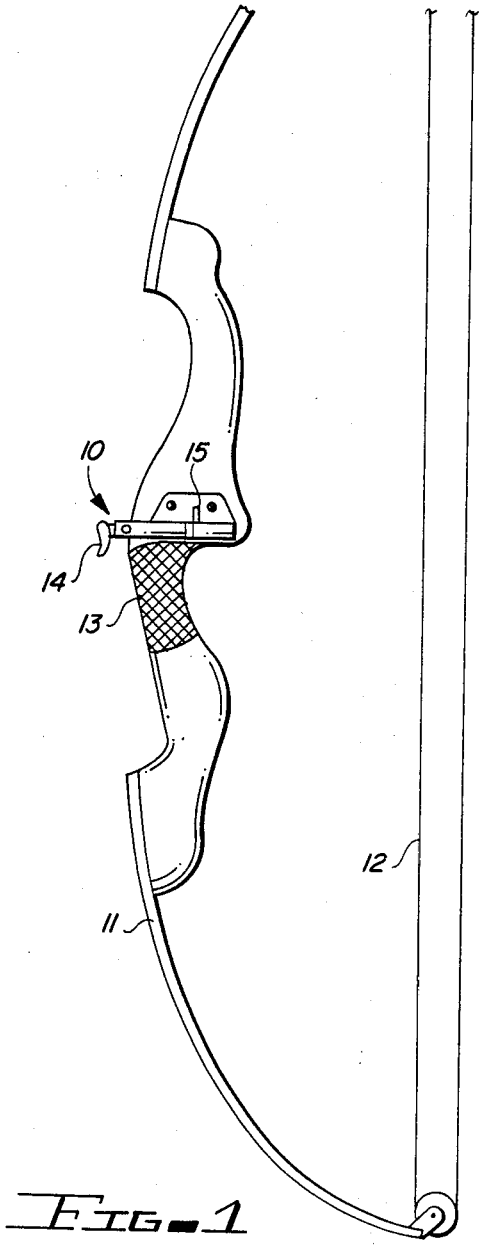
FIG. 1 is a side view of an archery bow with the arrow holder in place.

Referring now to the drawings, and particularly to FIG. 1, there is illustrated an arrow holder (10) positioned upon the body of an archery bow (11) with the bowstring (12) at its at rest position. The arrow holder (10) is situated on the side of the archery bow handle (13). It may be noted that the arrow holder trigger (14) is in the position whereby it would be in line with the bow hunter's forward arm and forefinger, without the necessity of rotating his/her wrist, when the bowstring (12) is drawn.

It may be recalled that it is an object of this invention to spring bias an arrow clamp (15) against the body of an archery bow (11), such that it may firmly hold an arrow (37) in place. The arrow clamp (15) is caused to rotate away from the arrow and body of the bow (11) when a trigger (14) is depressed. Accordingly, in reducing the invention to practice one converts the linear movement of a trigger (14) into rotational movement of the arrow clamp (15) so as to move the arrow clamp (15) away from the arrow and body of the bow (11). There are numerous means by which linear force is converted into rotational movement, and two (2) of such means are disclosed herein. It should be noted that other known means of converting linear force to rotational movement are within the spirit and scope of the invention claimed herein. The two means considered herein include firstly, a spiral passageway which rotates a follower and secondly, a rack and pinion gear arrangement.

Figure 2A:
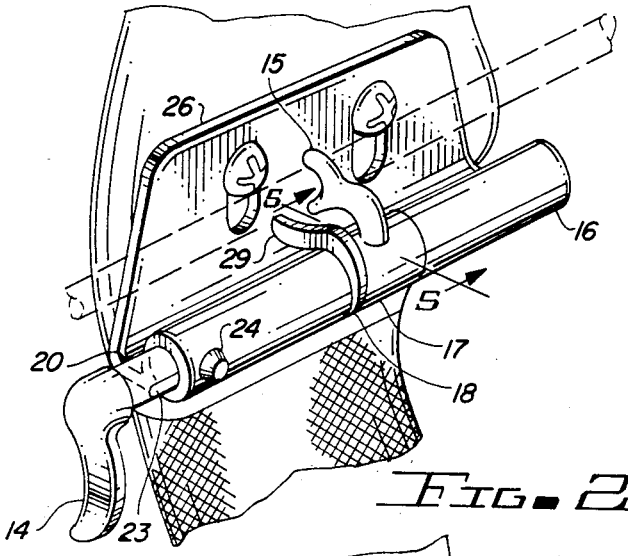
FIG. 2A is a perspective side view of the arrow holder with the arrow clamp biased against the body of the bow.
Figure 2B:
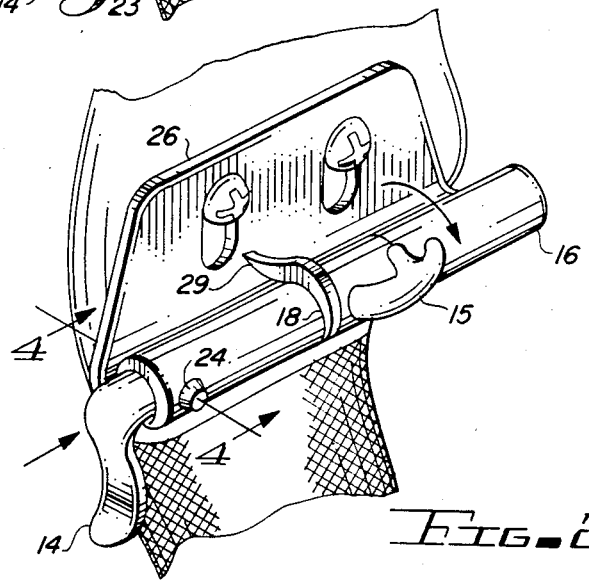
FIG. 2B is a perspective side view of an arrow holder with the arrow clamp rotated away from the body of the bow by the depressed trigger.
Figure 3:
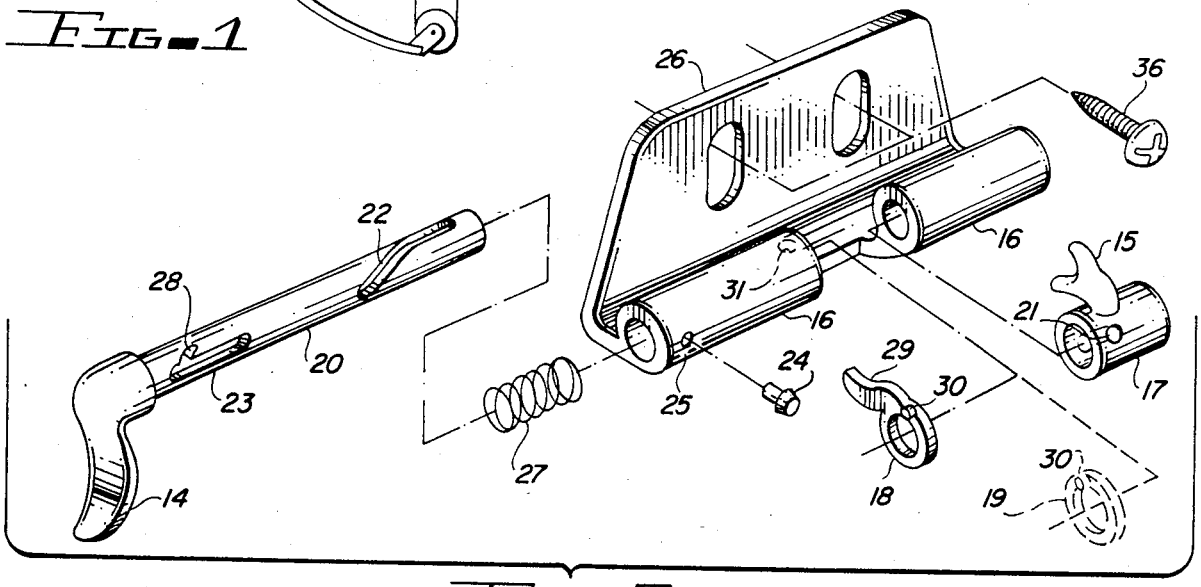
FIG. 3 is a perspective side view of a disassembled arrow holder.

The spiral passageway means are disclosed in FIGS. 2A through 6B. The trigger shaft sleeve (16) shown in FIG. 3 consists of two (2) separated hollow cylinders. The hollow cylinder of an arrow clamp collar (17) and arrow rest collar (18) or spacer (19) fit between the separated cylinders of the trigger shaft sleeve (16), as shown in FIGS. 2A, 2B and 3. The arrow rest collar (18) and spacer (19) are shown in FIG. 3. The trigger shaft (20) is inserted within the hollow cylindrical cavity provided by the trigger shaft sleeve (16), arrow rest collar (18) or spacer (19) and arrow clamp collar (17).

A follower (21) is provided on the interior surface of the arrow clamp collar (17). The follower (21) aligns with a spiral passageway (22) on the trigger shaft (20). As the trigger shaft (20) moves forward or backward, the follower (21) on the arrow clamp collar (17) is caused to rotate by the spiral passageway (22). This causes the arrow clamp (15) and collar (17) to also rotate.

A rotation lock groove (23) on the trigger shaft (20) aligns with a rotation lock pin (24) which may be inserted into a hole (25) in the trigger shaft sleeve (16). The interaction of the rotation lock groove (23) and rotation lock pin (24) maintain the rotational stability of the trigger shaft (20).

A mounting plate (26) may be provided on the trigger shaft sleeve (16) in order to conveniently attach the arrow holder (10) to the body of a bow (11). Affixation of the mounting plate (26) may be accomplished by adhesives or screws (36). In FIGS. 2A through 5B the mounting plate (26) is shown on the left of the trigger shaft sleeve (16), as viewed from the front. In this manner the unit may be used for the hunter whose left arm is preferably extended forward and right arm is used to draw the bowstring (12). A mirror image of the unit would accommodate the hunter who prefers his/her right arm to be extended forward. For convenience, in this application the figures and specification will discuss only the arrow holder (10) mounted on the right side of the body of the bow (11) when viewed from the front, however the mirror image is within the spirit and scope of the invention.

A spring (27) is provided at the rear of the trigger shaft sleeve (16). This spring (27) naturally biases the trigger shaft (20) to the front of the bow (11). When the trigger shaft (20) is forced forward, the arrow clamp (15) is rotated toward the body of the bow by the interaction of spiral passageway (22) and follower (21). A forward boundary on spring biased movement of the trigger shaft (20) is defined by the interface of the rotation lock pin (24) with the rear edge of the rotation lock groove (23). When the trigger (14) is depressed the spiral passageway (22) rotates the follower (21), thereby rotating the arrow clamp (15) away from the body of the bow (11). When the trigger (14) is released, the arrow clamp (15) rotates toward the body of the bow (11).

In a preferred embodiment the rotation lock groove (23) also comprises a detent (28) as shown in FIG. 3. When the trigger (14) is depressed, it may be slightly rotated so that the rotation lock pin (24) enters the detent (28). When the rotation lock pin (24) is situated in the detent (28), the arrow clamp (15) is locked in a position away from the body of the bow (11). Therefore, if a bow hunter prefers not to utilize the arrow clamp (15), it may conveniently be locked in a nonobtrusive position. The interaction of the detent (28) and rotation lock pin (24) establishes the forward boundary of the trigger shaft (20) when biased by the spring (27).

The unit may also comprise an arrow rest (29) upon which an arrow may be supported from below. The arrow rest (29) serves as a guide for the arrow when a drawn bowstring (12) is released, and it also serves as a lower support for the arrow when held in place by the arrow clamp (15). In a preferred embodiment, an arrow rest (29) is angularly disposed in a downward direction as it extends from the top of the trigger shaft sleeve (16) toward the mounting plate (26) as shown in FIGS. 2A through 5B. With this preferred embodiment of the arrow rest (29), deflection invariably caused by passing arrow vanes is balanced thereby minimizing divergence of the released arrow. If an arrow rest (29) is not utilized, it will be necessary to provide a spacer (19) as shown in FIG. 3 to assure a tight fit of the arrow clamp collar (17) in the trigger shaft sleeve (16). In order to assure that the arrow rest collar (18) and spacer (19) do not rotate, a key (30) is provided in the arrow rest collar (18) and spacer (19) to lock into a notch (31) provided in the trigger shaft sleeve (16).

The second disclosed means of converting the linear movement of the trigger (14) and (14') into a rotational movement of an arrow clamp (15) and (15') is illustrated in FIGS. 7 through 9 as the rack and pinion method.

Under the rack and pinion method a trigger shaft (20') with rack teeth (32), as shown in FIG. 7, is inserted within the trigger shaft sleeve (16') shown in FIGS. 7 through 9. The rack teeth (32) correspond with pinion shaft teeth (33) on an arrow clamp pinion gear (34), shown in FIG. 7, situated within a pinion housing (35). Again, the linear movement of the trigger shaft (20') is converted to a rotational movement of the arrow clamp (15') via an interaction between the rack teeth (32) and pinion shaft teeth (33). The arrow clamp (15') is naturally biased against the body of the bow (11) and mounting plate (26') by means of a spring (27') situated within the trigger shaft sleeve (16') which naturally biases the trigger (14') to its forward position. Rotational stability of the trigger shaft (20') is established by the interaction between the rotation lock groove (23') in the trigger shaft (20') and the rotation lock pin (24') inserted in a hole (25') in the trigger shaft sleeve (16'). The rotation lock groove (23') and rotation lock pin (24') also establish the forward boundary of the trigger shaft (20') which is biased by the spring (27').

As in the spiral passageway means of converting linear to rotational movement, the rotation lock groove (23') of the rack and pinion method may also comprise a detent (28') into which the pin (24') may slide so as to lock the arrow clamp (15') in a nonobtrusive position.

It can therefore be seen that an arrow clamp (15 and 15') has been provided to securely hold an arrow against the body of a bow (11) when the bowstring (12) is at rest and also while it is drawn. The arrow clamp (15 and 15') can easily be removed from the arrow's line of flight by depressing a trigger (14 and 14') conveniently positioned under the hunter's forward arm's forefinger.

While two (2) specific embodiments of the invention have been described in detail above, it is to be understood that various modifications may be made from the specific details described, without departing from the spirit and scope of the invention.

What is claimed is:

1. An arrow holder which may be attached to an archery bow which comprises:

a. a rotatable arrow clamp, b. a trigger, c. a means for biasing the arrow clamp toward the body of the bow when the trigger is not depressed, d. a hollow arrow clamp collar onto which the arrow clamp is mounted, e. a follower affixed to the inner surface of the hollow arrow clamp collar, f. a rotation lock pin, g. a hollow trigger shaft sleeve having a rotation lock aperture, which may accommodate the insertion of said rotation lock pin, the hollow trigger shaft sleeve comprising two hollow sections separated by the axial length of the arrow clamp collar so as to facilitate coaxial alignment of the two sections and the collar, and h. a trigger shaft onto which the trigger is mounted and which may be inserted into the hollow passage provided by the trigger shaft sleeve and the arrow clamp collar when coaxially aligned, the trigger shaft also comprising a rotation lock groove which aligns with the rotation lock pin when inserted in the rotation lock aperture, and further comprises a spiral passageway which aligns with the follower so as to cause the arrow clamp to be rotated away from the body of the bow when the trigger is depressed.

2. The arrow holder of claim 1 wherein the means for biasing the arrow clamp toward the body of the bow when the trigger is not depressed comprises the installation of a spring within the trigger shaft sleeve which biases the trigger shaft and its spiral passageway in the direction whereby it causes the follower to rotate the arrow clamp toward the body of the bow.

3. The arrow holder of claim 1 which further comprises a mounting plate to facilitate the affixation of the arrow holder onto the body of an archery bow.

4. The arrow holder of claim 3 which further comprises an arrow rest affixed to the top of the trigger shaft sleeve, angularly disposed in a downward direction toward the mounting plate.

5. The arrow holder of claim 1 wherein the rotation lock groove also comprises a detent into which the rotation lock pin may rest when the arrow clamp is rotated away from the body of the bow.

* * * * *